US009791172B2

(12) United States Patent
Wang et al.

(10) Patent No.: US 9,791,172 B2
(45) Date of Patent: Oct. 17, 2017

(54) DUAL SENSOR COMBUSTION SYSTEM

(71) Applicant: A. O. SMITH CORPORATION, Milwaukee, WI (US)

(72) Inventors: Wei Wang, Nanjing (CN); Dayan Bi, Nanjing (CN)

(73) Assignee: A. O. Smith Corporation, Milwaukee, WI (US)

( * ) Notice: Subject to any disclaimer, the term of this patent is extended or adjusted under 35 U.S.C. 154(b) by 132 days.

(21) Appl. No.: 14/875,322

(22) Filed: Oct. 5, 2015

(65) Prior Publication Data

US 2017/0082320 A1 Mar. 23, 2017

(30) Foreign Application Priority Data

Sep. 22, 2015 (CN) ..... 2015 1 0609510

(51) Int. Cl.
*F24H 9/20* (2006.01)
*F23N 5/12* (2006.01)
*F23N 1/02* (2006.01)

(52) U.S. Cl.
CPC ..... *F24H 9/2035* (2013.01); *F23N 1/022* (2013.01); *F23N 5/123* (2013.01); *F23N 2041/04* (2013.01)

(58) Field of Classification Search
CPC ..... F23N 2041/04; F23N 2025/04; F24H 9/2035; F22B 35/00
See application file for complete search history.

(56) References Cited

U.S. PATENT DOCUMENTS 8,813,776 B2 * 8/2014 Stark ..... G05D 16/2013 137/487.5
9,175,853 B2 * 11/2015 Fioriti ..... F23N 5/006
9,291,355 B2 * 3/2016 Hugghins ..... F23N 3/082
9,513,003 B2 * 12/2016 Watanabe ..... F23L 11/02
2014/0209042 A1 * 7/2014 Hardesty ..... F24H 1/186 122/14.3
2015/0233578 A1 * 8/2015 Monteiro ..... F23N 3/082 431/12

* cited by examiner

*Primary Examiner* — Gregory A Wilson
(74) *Attorney, Agent, or Firm* — Michael Best & Friedrich LLP

(57) ABSTRACT

The embodiments of the present application disclose a dual sensor combustion system. The dual sensor combustion system comprises: a combustor; a stepless speed regulating fan that supplies air for the combustor; a fuel gas conduit that is in communication with the combustor; a proportional valve provided on the fuel gas conduit; a control unit electrically connected to the stepless speed regulating fan and the proportional valve; a first pressure sensor assembly that detects a first pressure signal of the gas flow passage; a second pressure sensor assembly that detects a second pressure signal of the fuel gas conduit; a storage that stores a correspondence relationship between a first target pressure signal of the gas flow passage and a second target pressure signal of the fuel gas conduit; and the control unit controlling at least one of the stepless speed regulating fan and the proportional valve based on the first pressure signal, the second pressure signal and the correspondence relationship.

27 Claims, 4 Drawing Sheets

DUAL SENSOR COMBUSTION SYSTEM

The present claims the priority of the Chinese patent application No. 201510609510.3, of which the application date is Sep. 22, 2015, and the present refers to the whole text of the patent application No. 201510609510.3.

TECHNICAL FIELD

The present application relates to the field of water heater, in particular to a dual sensor combustion system.

BACKGROUND TECHNOLOGY

In the prior art, there are different requirements for thermal load of the combustor of a gas water heater or a wall-hanging boiler, according to different demands for the amount and temperature of hot water. For example, when there is a need for a large amount of hot water, the combustor needs to have greater thermal load, while when a small amount of hot water is required, the combustor only needs to have a smaller thermal load.

Currently, thermal load of the combustor is controlled mainly by controlling currents of the proportional valve and the fan. To be specific, when greater thermal load is needed, a larger current will be supplied to the proportional valve, so that the proportional valve can have a bigger opening, and thereby more fuel gas will be allowed to pass through the proportional valve and reach the combustor for combustion; meanwhile, a larger current will also be supplied to the fan to provide the fan with greater rotation speed to increase the flow of combustion air, such that the fuel gas can be better combusted in the combustor, and thereby the combustor has a greater thermal load.

Under ideal conditions, the currents of the proportional valve and the fan are in correspondence relationship with each other, i.e., a determined current allows the proportional valve to have a determined opening. In general, the flow of fuel gas that passes through the proportional valve is in correspondence relationship with the opening of the proportional valve, and, since the flow of the fuel gas is also in correspondence relationship with the flow of combustion-supporting air required for the combustion, the current of the proportional valve and the flow of the combustion-supporting air are also in correspondence relationship with each other. Furthermore, Forming the flow of the combustion-supporting air is in correspondence relationship with both of the rotation speed and current of the demanded fan, so that the current of the proportional valve and the current of the fan are also in correspondence relationship with each other. Due to the above correspondence relationships, the gas water heater and wall-hanging boiler in the prior art mostly apply a method of correspondingly controlling the currents of the proportional valve and the fan, so as to control the thermal load of the combustor.

However, in real life, the operation environments may vary for gas hot water supplying apparatus in different regions, the conventional gas hot water supplying apparatus may well be used in some regions, but in other regions, phenomena of low thermal load or insufficient combustion of the combustor may appear. For example, in different regions the fuel gas pressure may be different, so, when current of the proportional valve is set according to a general standard, it is hard to be adapted to the regions where the fuel gas pressure is lower or higher. For example, in the regions where a fuel gas pressure is lower, there may appear the phenomenon of low combustion load; while in the regions where the fuel gas pressure is higher, there may appear the phenomenon of insufficient combustion of the fuel gas. In addition, in a same workplace, changes may also occur in a pressure of the fuel gas pipeline, which will influence the flow of fuel gas that passes through the proportional valve, and thereby may also lead to the above problems.

SUMMARY

The embodiments of the present application provide a dual sensor combustion system.

The present application provides a dual sensor combustion system, the dual sensor combustion system in its interior has a gas flow passage from an air inlet to an smoke exhaust port, the dual sensor combustion system comprising: a combustor; a stepless speed regulating fan that is supplies air for the combustor; a fuel gas conduit that is in communication with the combustor; a proportional valve provided on the fuel gas conduit; a control unit electrically connected to the stepless speed regulating fan and the proportional valve; a first pressure sensor assembly that detects a first pressure signal of the gas flow passage, a signal output end of the first pressure sensor assembly being connected to the control unit; a second pressure sensor assembly that detects a second pressure signal of the fuel gas conduit, a signal output end of the second pressure sensor assembly being connected to the control unit; a storage that stores a correspondence relationship between a first target pressure signal of the gas flow passage and a second target pressure signal of the fuel gas conduit; and the control unit controlling at least one of the stepless speed regulating fan and the proportional valve based on the first pressure signal, the second pressure signal and the correspondence relationship.

BRIEF DESCRIPTION OF THE DRAWINGS

In order to explain more clearly the embodiments in the present application or the technical solutions in the prior art, figures needed in the description of the embodiments or the prior art will be introduced briefly in the following. Obviously, figures in the following description are only some embodiments of the present application, and for a person skilled in the art, other figures can also be obtained based on these figures without paying any creative effort.

DETAILED DESCRIPTION

In order to enable the persons skilled in the art to better understand the technical solutions in this application, clear and comprehensive description will be made to the technical solutions in the embodiments of this application in the following in combination with the figures of the embodiments of this application. Obviously, the embodiments described herein are only part of the embodiments of the present application rather than all the embodiments thereof.

Based on the embodiments of the present application, all other embodiments obtained by ordinary skilled persons in the field without paying any creative effort should pertain to the scope of protection of the present application.

Figure 1:
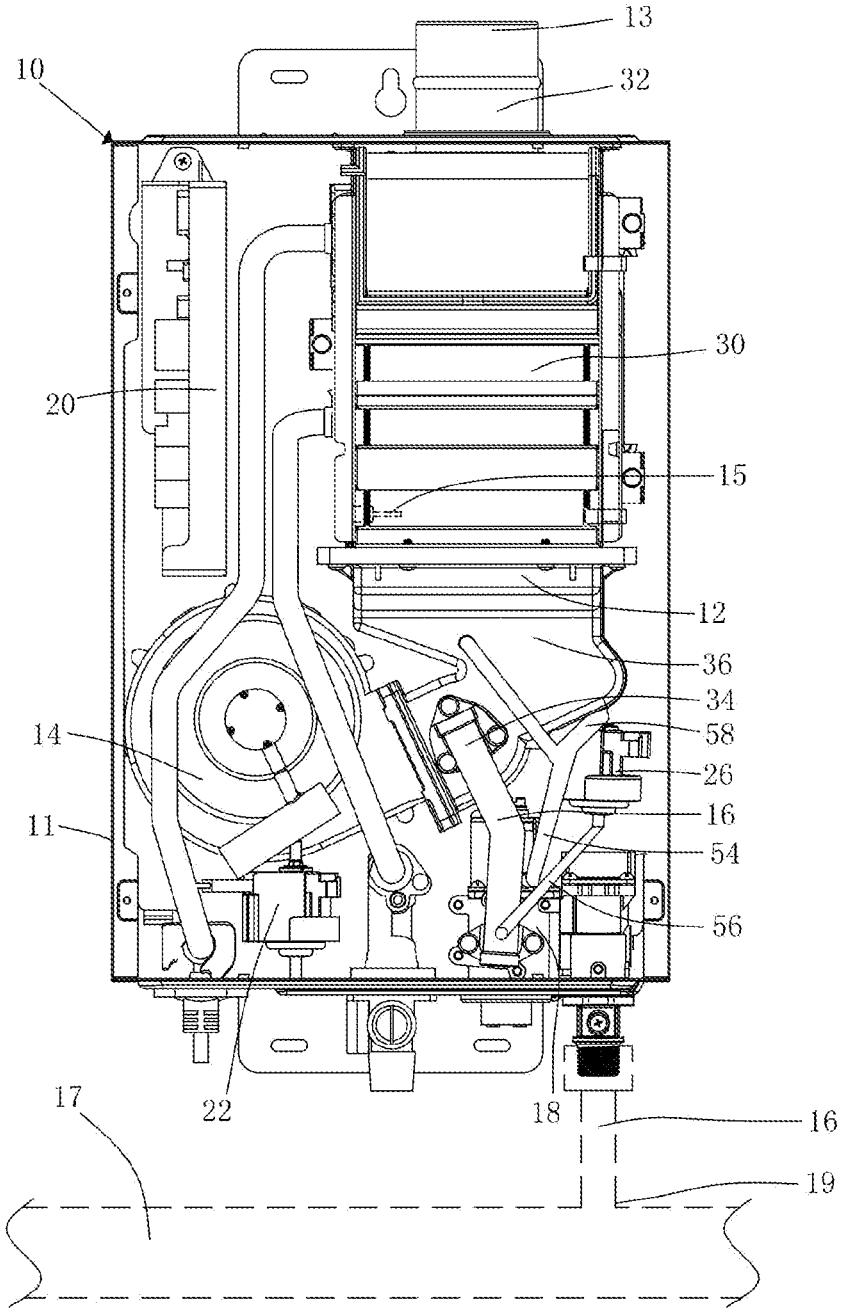
FIG. 1 is a structural diagram of the gas water heater provided by one embodiment of the present application.
Figure 2:
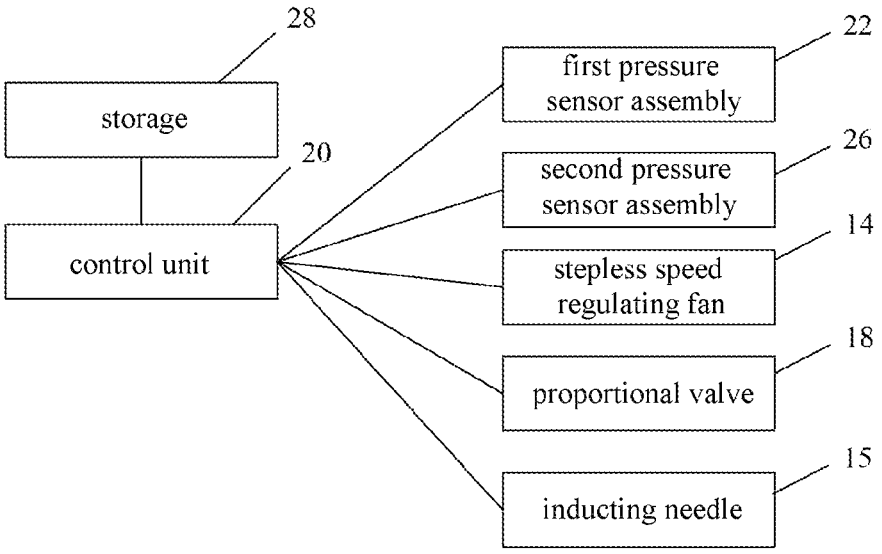
FIG. 2 is a diagram of the modules related to the electric control parts provided by one embodiment of the present application.

Please refer to FIG. 1 and FIG. 2 together. A dual sensor combustion system 10 provided in one embodiment of the present application is provided with a gas flow passage in its interior from an air inlet 11 to a smoke exhaust port 13. The dual sensor combustion system 10 comprises: a combustor 12; a stepless speed regulating fan 14 that supplies air for the combustor 12; a fuel gas conduit 16 that is in communication with the combustor 12; a proportional valve 18 provided on the fuel gas conduit 16; a control unit 20 electrically connected to the stepless speed regulating fan 14 and the proportional valve 18; a first pressure sensor assembly 22 that detects a first pressure signal of the gas flow passage, a signal output end of the first pressure sensor assembly being connected to the control unit 20; a second pressure sensor assembly 26 that detects a second pressure signal of the fuel gas conduit 16, a signal output end of the second pressure sensor assembly being connected to the control unit 20; a storage 28 that stores a correspondence relationship between a first target pressure signal of the gas flow passage and a second target pressure signal of the fuel gas conduit 16; and the control unit 20 controlling at least one of the stepless speed regulating fan 14 and the proportional valve 18 based on the first pressure signal, the second pressure signal and the correspondence relationship.

In the embodiments of the present application, by setting the first target pressure signal of the gas flow passage and the second target pressure signal of the fuel gas conduit, it is possible to achieve to set different target standards for different operation states. By establishing a correspondence relationship between the first target pressure signal and the second target pressure signal, during control, according to the currently detected first pressure signal and second pressure signal it is possible to selectively control at least one of the stepless speed regulating fan and the proportional valve to thereby satisfy the demand of the dual sensor combustion system 10 for heat energy during operation. Then, the dual sensor combustion system 10 can better control and harmonize the proportional valve and the stepless speed regulating fan in different operation environments including pressure in the fuel gas pipeline and the outside wind pressure. etc., so as to realize that the gas hot water supplying apparatus can operate steadily. In addition, by matching the first target pressure signal and the second pressure signal, it is possible to achieve more precise ensurance of optimized partition ratio of the actual flow of air and fuel gas, so as to make the fuel gas be combusted more sufficiently, thereby a discharged pollutant can be very few.

The gas flow passage of the dual sensor combustion system 10 may be a gas passage that is formed from the air inlet 11 of its housing and passes through the combustor 12, a heat exchanger 30 of the dual sensor combustion system 10, the stepless speed regulating fan 14 and the smoke exhaust pipe 32. The smoke exhaust port 13 may be an outlet of the smoke exhaust pipe 32. Of course, the sequence in which the gas flow passage is formed is not limited to the above description, and the gas flow passage may also be a gas passage that is formed from the air inlet 11 and passes through the stepless speed regulating fan 14, the combustor 12, the heat exchanger 30 of the dual sensor combustion system 10 and the smoke exhaust pipe 32. Of course, under the inspiration of the technical essence of the present application, a person skilled in the art can also make other alternations, which should all be included in the protection scope of the present application so long as the achieved functions and the obtained effects are identical or similar to that of the present application.

Fuel gas in the fuel gas conduit 16 can be combusted at the combustor 12 to release heat energy, such that the heat exchanger of the dual sensor combustion system 10 can absorb the heat energy to heat the water that flows through. The proportional valve 18 is provided on the fuel gas conduit 16, an opening of the proportional valve 18 can be controlled by controlling its current, and thereby an amount of fuel gas that passes through the proportional valve 18 can be controlled. As such, it is achievable to control an amount of fuel gas that reaches the combustor 12. Since different amount of fuel gas in the combustor 12 will affect the thermal load of combustion in the combustor 12, the function of controlling an amount of hot water and temperature can be achieved.

The stepless speed regulating fan 14 may be a direct current fan, a rotation speed of the stepless speed regulating fan 14 can be controlled by controlling its current. The rotation speed of the stepless speed regulating fan 14 will affect the flow speed of gas in the gas flow passage. In general states, the greater the rotation speed of the stepless speed regulating fan 14 is, the greater the gas flow speed of gas in the gas flow passage is; and, the slower the rotation speed of the stepless speed regulating fan 14 is, the slower the flow speed of gas in the gas flow passage is. The stepless speed regulating fan 14 can drive gas in the gas flow passage to flow from the air inlet 11 to the smoke exhaust port 13. During the process, air that enters the gas flow passage from the air inlet 11 can be used for combustion of the fuel gas in the combustor 12. That is to say, the stepless speed regulating fan 14 drives the gas to move, so as to supply air for the combustion of fuel gas in the combustor 12. The stepless speed regulating fan 14 can specifically include: a fan housing, a impeller provided inside the fan housing, and a motor for driving the impeller to rotate, wherein the motor can be provided inside or outside the fan housing.

The control unit 20 is electrically connected to the stepless speed regulating fan 14 and the proportional valve 18. The control unit 20 can control a rotation speed of the stepless speed regulating fan 14 by controlling a current of the stepless speed regulating fan 14. The control unit 20 can control the opening of the proportional valve 18 by controlling a current of the proportional valve 18. The control unit 20 can include a microprocessor, a fan driving circuit connected to the microprocessor and the stepless speed regulating fan 14, and a proportional valve driving circuit connected to the microprocessor and the proportional valve 18.

The first pressure sensor assembly 22 can collect a first pressure signal in the gas flow passage. The first pressure signal can represent a state of gas pressure in the gas flow passage. The first pressure sensor assembly 22 is connected with the control unit 20, such that the collected first pressure signal can be supplied to the control unit 20. The second pressure sensor assembly 26 can collect the second pressure signal in the fuel gas conduit 16. Similarly, the second pressure signal is used to represent a state of gas pressure in the fuel gas conduit 16. The second pressure sensor assembly 26 is connected with the control unit 20, such that the collected second pressure signal can be supplied to the control unit 20. To be specific, for example, the first pressure signal and the second pressure signal are supplied to the microprocessor.

The storage 28 can be used for storing data. The storage 28 can be a magnetic storage, and can also be a digital storage. Preferably, it is a digital storage. Generally, during operation, the dual sensor combustion system will receive user instructions and set a temperature of the hot water. As such, according to the temperature of the hot water and the flow of the supplied water, the required flow of fuel gas and the flow of air needed for combustion of the fuel gas can be determined. As such, there is a correspondence relationship between air flow and fuel gas flow. Furthermore, a certain air flow and a certain fuel gas flow will each correspond to a gas pressure state, and the gas pressure states corresponding respectively to the two will be taken as the first target pressure signal and the second target pressure signal. As such, the control unit 20 has a standard for controlling the stepless speed regulating fan 14 and the proportional valve 18. The currents of the stepless speed regulating fan 14 and the proportional valve 18 can be controlled based on the above correspondence relationship. To be specific, pressure difference may be applied to represent the gas pressure states.

In a specific embodiment, a currently set outlet water temperature is 40 degrees, and the control unit 20 can control the stepless speed regulating fan 14 to be in a predetermined rotation speed and control the proportional valve 18 to be in a predetermined opening. At this time, assume that the outlet water temperature of the dual sensor combustion system 10 may be 35 degrees, thus the water temperature needs to be raised further. The control unit 20 can control the stepless speed regulating fan 14 to increase its rotation speed, and can control the proportional valve 18 to increase its opening, during which process, the control unit 20 will regulate the stepless speed regulating fan 14 and the proportional valve 18 based on the correspondence relationship between the first target pressure signal and the second target pressure signal, so as to correspondingly increase the first pressure signal and the second pressure signal. When the outlet water temperature reaches the set outlet water temperature, the control unit 20 can control the stepless speed regulating fan 14 to maintain the current rotation speed and control the proportional valve 18 to maintain the current opening, so as to realize the maintenance of the first pressure signal and the second pressure signal based on the correspondence relationship.

It can be understood that, during a specific regulation process, the following situations may occur: an opening of the proportional valve 18 is kept unchanged while the stepless speed regulating fan 14 is controlled to regulate its rotation speed; or a rotation speed of the stepless speed regulating fan 14 is kept unchanged while the proportional valve 18 is controlled to regulate its opening; or, the stepless speed regulating fan 14 is controlled to regulate its rotation speed and the proportional valve 18 are controlled to regulate it opening simultaneously.

Figure 3:
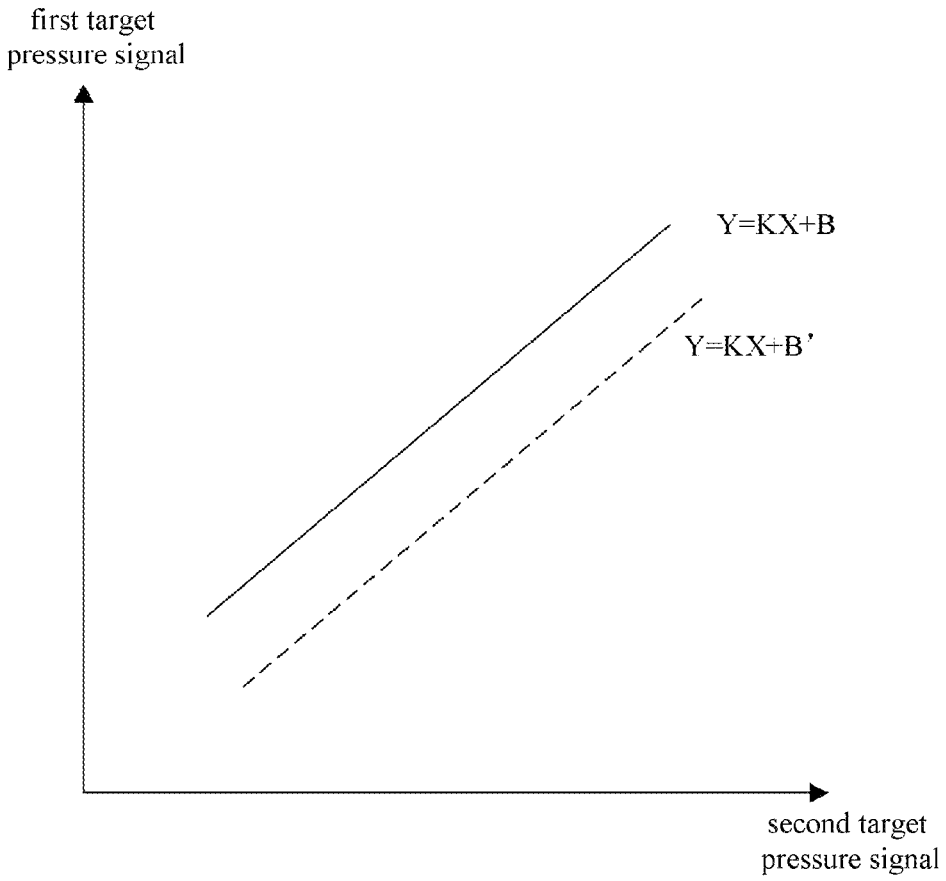
FIG. 3 is a diagram of the correspondence relationship between the first target pressure signal and the second target pressure signal provided by one embodiment of the present application.

In this embodiment, the correspondence relationship can include a function to represent the relationship between the first target pressure signal and the second target pressure signal. Then the corresponding first target pressure signal and second target pressure signal are obtained by operation of the function. The correspondence relationship can also include a data table in which the first target pressure signal and the second target pressure signal obtained through experimentations are correspondingly recorded. To be specific, as can be seen in FIG. 3, the correspondence relationship between the first target pressure signal and the second target pressure signal can be represented by the function $Y=KX+B$. Wherein Y represents the first pressure signal, X represents the second pressure signal, K is a proportionality coefficient which is obtained based on experiment statistical rules between X and Y, and B is a constant.

In one embodiment, the fuel gas conduit 16 has a connection section 19 capable of being connected to a fuel gas pipeline 17, the fuel gas pipeline 17 supplies fuel gas for the fuel gas conduit 16; the second pressure signal is a pressure signal between the outlet end 34 of the fuel gas conduit 16 and the connection section 19. The fuel gas pipeline 17 may be public facilities such as pipelines that transport fuel gas to each building. The fuel gas conduit 16 is a conduit that is directly connected to the dual sensor combustion system 10. Generally, an inner diameter of the fuel gas conduit 16 is less than an inner diameter of the fuel gas pipeline 17, such that the fuel gas pipeline 17 can supply fuel gas for multiple users. The second pressure signal is a pressure signal between the outlet end 34 and the connection section 19, such that the second pressure signal can be used to represent a pressure state of fuel gas that enters into the dual sensor combustion system 10, to be advantageous for the control unit to accurately control the opening of the proportional valve 18.

In one embodiment, the proportional valve 18 is located between the connection section 19 and the outlet end 34, and the second pressure signal is a pressure signal between the proportional valve 18 and the outlet end 34. As such arrangement, so that the second pressure signal detected by the second pressure sensor assembly 26 represents a pressure state of fuel gas that has passed through the proportional valve 18, such that an amount of fuel gas that reaches the combustor 12 subsequently can be represented more accurately. Besides, the control unit 20 can control the opening of the proportional valve 18 based on whether the second pressure signal has reached the second target pressure signal, so as to realize more accurate control of the combustion state in the combustor 12.

It can be understood that, the value of the second target pressure signal can be set based on a position where the second pressure signal is detected.

In one embodiment, the storage 28 stores a correspondence relationship between the first target pressure signal of the gas flow passage, the second target pressure signal of the fuel gas conduit 16 and a preset parameter of the dual sensor combustion system 10, the control unit 20 controls at least one of the stepless speed regulating fan 14 and the proportional valve 18 based on the first pressure signal, the second pressure signal and the correspondence relationship.

In the present embodiment, the preset parameters can include parameters related to the outlet water temperature of the dual sensor combustion system 10. To be specific, for example, the preset parameters can include thermal load, ion current signal value and set water temperature, etc. of the dual sensor combustion system 10.

In the present embodiment, by storing the correspondence relationship between the preset parameters of the dual sensor combustion system 10 and the first target pressure signal, the second target pressure signal, after the dual sensor combustion system 10 starts to operate, to determine the first target pressure signal and the second target pressure signal based on the currently provided preset parameters and the correspondence relationship. As such, the control unit 20 can control a rotation speed of the stepless speed regulating fan 14 to make the first pressure signal tend to the first target pressure signal; the control unit can control the opening of the proportional valve 18 to make the second pressure signal tend to the second target pressure signal. Of course, the control unit 20 can simultaneously control the stepless speed regulating fan 14 and the proportional valve 18, so as to make the first pressure signal tend to the first target pressure signal and make the second pressure signal tend to the second target pressure signal.

In one embodiment, the dual sensor combustion system 10 may be in a blowing-type structure. The stepless speed regulating fan 14 is located upstream of the combustor 12 along a flow direction of air flow in the gas flow passage. As such, air that enters from the air inlet 11 of the dual sensor combustion system 10 can first reach the stepless speed regulating fan 14, and then the air flow blown out from the stepless speed regulating fan 14 can supply air for combustion of fuel gas in the combustor 12. The stepless speed regulating fan 14 can be provided at a lower section inside the whole dual sensor combustion system 10, such that the airflow blown out from the stepless speed regulating fan 14 can move towards an upper section of the dual sensor combustion system 10. Of course, the dual sensor combustion system 10 may also be in an downdraught structure. The stepless speed regulating fan 14 is located downstream of the combustor 12 along a flow direction of the airflow in the gas flow passage. As such, the air that enters from the air inlet 11 of the dual sensor combustion system 10 will first reach the combustor 12, and flow through the heat exchanger 30, and then reach the stepless speed regulating fan 14. Rotation of the impeller of the stepless speed regulating fan 14 can drive gas to flow, so as to drive air to enter the dual sensor combustion system 10 through the air inlet 11 and then to flow out from the smoke exhaust port.

In one embodiment, the first pressure signal detected by the first pressure sensor assembly is a pressure signal at an upstream of the impeller of the stepless speed regulating fan.

In the present embodiment, during operation of the stepless speed regulating fan 14, a certain negative pressure region will be formed upstream of the impeller along a flow direction, wherein, the greater the rotation speed of the impeller is, the lower the gas pressure in the formed negative pressure region is, and the pressure in the negative pressure region will be lower than an ambient air pressure of the environment in which the dual sensor combustion system 10 is located, such that air is driven to enter into the dual sensor combustion system 10 from the air inlet 11. In some situation, when there is reverse wind pressure in the operation environment of the dual sensor combustion system 10, it will affect the rotation speed of the impeller, such as will be possible to decrease the rotation speed of the impeller, and at this time the pressure in the negative pressure region will increase. As such, it can be seen that by detecting a change of pressure in the negative pressure region, the operation state of the stepless speed regulating fan 14 can be acquired. Besides, the change of pressure in the negative pressure region can influence the flow speed of gas in the gas flow passage. When pressure in the negative pressure region increases, it may cause decrease in the gas flow speed, and thereby cause insufficient supply of air required for the combustion of the fuel gas to the combustor. So, by detecting the first pressure signal at the upstream of the impeller, the control unit 20 can control the stepless speed regulating fan 14 to raise its rotation speed when the first pressure signal is lower than the first target pressure signal, so as to make the first pressure signal tend to the first target pressure signal, thereby realize the maintenance of normal operation of the combustor 12.

In one embodiment, the first pressure sensor assembly 22 has a first conduit that is in communication with a first predetermined pressure measuring position downstream of the impeller of the stepless speed regulating fan and a second conduit that is in communication with a second predetermined pressure measuring position downstream of the impeller of the stepless speed regulating fan, and the first predetermined pressure measuring position is located upstream of the second predetermined pressure measuring position.

In the present embodiment, at a downstream of the stepless speed regulating fan 14, the gas pressure of the gas will also change along with a change of a distance from the stepless speed regulating fan 14. The first predetermined pressure measuring position and the second predetermined pressure measuring position are preset downstream of the impeller, such that the first pressure sensor assembly 22 can collect the current gas pressures of multiple positions. During operation of the stepless speed regulating fan 14, a high pressure region will be generated downstream of the impeller, and pressure in the high pressure region may be higher than an ambient air pressure of the environment in which the dual sensor combustion system 10 is located, such that gas in the dual sensor combustion system 10 will be exhausted from an interior of the dual sensor combustion system 10 towards outside through the smoke exhaust port. To be specific, the first predetermined pressure measuring position and the second predetermined pressure measuring position can be located at the air outlet of the stepless speed regulating fan 14, and can also be located at the smoke exhaust pipe 32, or, the first predetermined pressure measuring position is located at the air outlet, and the second predetermined pressure measuring position is located at the smoke exhaust pipe 32. Of course, under the inspiration of the technical essence of the present application, a person skilled in the art can also make other alternations based on the practical designs, which should all be included in the protection scope of the present application so long as the achieved functions and effects are identical or similar to that of the present application.

In the present embodiment, the first pressure sensor assembly 22 can have two pressure measuring ports, of which one is in communication with the first predetermined pressure measuring position via the first conduit and the other one is in communication with the second predetermined pressure measuring position via the second conduit.

In the present embodiment, the first pressure sensor assembly 22 obtains a third pressure signal by detecting the first conduit, and obtains a fourth pressure signal by detecting the second conduit; the first pressure signal output by the first pressure sensor assembly 22 to the control unit 20 is a difference value between the third pressure signal and the fourth pressure signal.

In the present embodiment, in the gas flow passage, gas pressure will change along with the change of a distance from the stepless speed regulating fan 14. According to Bernoulli's equation in hydromechanics, the flow of air can be determined by calculation based on a pressure difference between two points in the gas flow passage. The difference value is fed back to the control unit 20 as the first pressure signal, such that the control unit 20 can more accurately control the rotation speed of the stepless speed regulating fan 14 based on a relationship between the first pressure signal and the first target pressure signal, thereby allowing the first pressure signal to tend to the first target pressure signal, so as to realize that the fuel gas can be combusted more stably in the combustor 12, and that the dual sensor combustion system 10 can have a relative stable outlet water temperature.

In one embodiment, the dual sensor combustion system 10 may further comprises a premix chamber 36 that is in communication with the combustor 12, the outlet end 34 of the fuel gas conduit 16 and the stepless speed regulating fan 14; fuel gas flowed out from the fuel gas conduit 16 and the air supplied by the gas flow passage can reach the combustor 12 after being premixed in the premix chamber 36.

In the present embodiment, the dual sensor combustion system 10 has the premix chamber 36, thus the fuel gas and the air can be mixed in the premix chamber 36, and then reach the combustor 12 for combustion. As such, flame in the combustor 12 can be relatively more stable. In addition, by controlling an amount of the fuel gas and the air, the supply of the two will be more reasonable.

Figure 4:
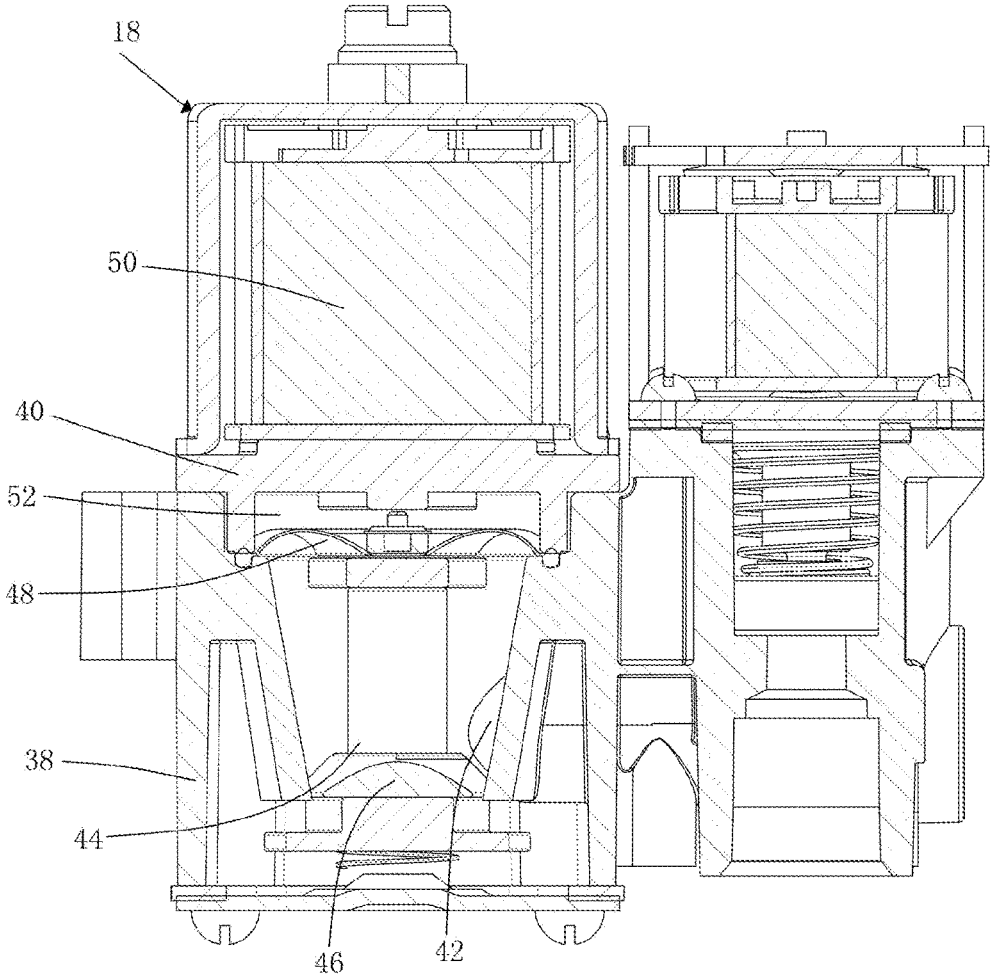
FIG. 4 is a structural diagram of the proportional valve provided by one embodiment of the present application.

Please refer to FIG. 4. In one embodiment, the proportional valve 18 has a first housing 38 and a second housing 40; the first housing 38 is formed with a fuel gas inlet 42 and a fuel gas outlet 44, and a valve cartridge 46 of the proportional valve 18 is provided at the fuel gas outlet 44; a leather diaphragm 48 of the proportional valve 18 is provided between the first housing 38 and the second housing 40 and is connected to a valve cartridge driving mechanism 50 of the proportional valve 18; and a sealed space is formed at least by the second housing 40 and the leather diaphragm 48. The dual sensor combustion system 10 further comprises a third conduit 54 that communicates the sealed space 52 with the premix chamber 36.

In the present embodiment, the sealed space 52 can be formed at least by the second housing 40 and the leather diaphragm 48. The first housing 38 and the second housing 40 may have a joint section therebetween, and an edge portion of the leather diaphragm 48 is located in the joint section, so that the sealed space 52 can be formed at least by enclosure of the second housing 40 and the leather diaphragm 48. Of course, the sealed space 52 can also be formed by jointly enclosure of the first housing 28, the second housing 40 and the leather diaphragm 48.

In the present embodiment, the fuel gas inlet 42 and the fuel gas outlet 44 of the first housing 38 can both be connected to the fuel gas conduit 16, such that an interior flow path of the proportional valve 18 becomes a part of the flow path of the fuel gas conduit 16. Besides, by controlling an opening between the valve cartridge 46 and the fuel gas outlet 44, the flow of fuel gas at the outlet end 34 of the fuel gas conduit 16 can be controlled, thereby achieving control of the flow of the fuel gas that reaches the combustor.

In the present embodiment, the valve cartridge driving mechanism 50 can drive the valve cartridge 46 to move, so as to regulate the opening. The valve cartridge driving mechanism 50 is connected with the leather diaphragm 48. Since the leather diaphragm 48 has a certain space to deform, it provides space for movement of the valve cartridge driving mechanism 50 driving the valve cartridge 46. During movement of the valve cartridge driving mechanism 50, the leather diaphragm 48 can prevent fuel gas from reaching inside the sealed space 52, and thereby prevents leakage of the fuel gas. To be specific, the valve cartridge driving mechanism 50 can include a power section and a drive rod, the drive rod is connected with the valve cartridge 46 after passing through the leather diaphragm 48, and the power section drives the drive rod and thereby drives the valve cartridge 46 to regulate the opening. Or, the valve cartridge driving mechanism 50 includes a driving section and an electromagnet which is securely connected to the leather diaphragm 48, a magnetic force will be generated between the driving section and the electromagnet after the driving section is energized, thus the electromagnet can drive the magnetic valve cartridge 46 to move to regulate the opening by using the magnetic force.

In the present embodiment, during operation of the dual sensor combustion system 10, there may present an air flow in the environment where it is located. For example, there is wind in the natural world. Since the air flow in the environment is hard to be controlled, a reverse wind pressure may appear for the dual sensor combustion system 10. That is, the flow direction of the airflow in the environment is opposite to the flow direction of the gas in the gas flow passage of the dual sensor combustion system 10. At this time, gas pressure inside the dual sensor combustion system 10 will be affected to some extent, in addition, a change of gas pressure inside the gas flow passage will affect the opening of the proportional valve 18. The proportional valve 18 achieves regulation of the opening by driving the valve cartridge 46, in some situation, when there is reverse pressure in the gas flow passage, the force that the proportional valve 18 drives the valve cartridge will suffer a reversed force, such that the opening of the proportional valve 18 may decrease, which will affect the flow of the fuel gas. In the present embodiment, the sealed space 52 is in communication with the premix chamber 36 via a third conduit, such that when pressure inside the gas flow passage changes, such as increases, the third conduit will form a certain linkage between the change of pressures in the premix chamber 36 and that in the sealed space 52. This will constitute a certain compensation for the force of the proportional valve 18 driving the valve cartridge 46, so as to allow the valve cartridge 46 to reach a normal opening. To be specific, for example, under a reverse wind pressure, the gas pressure inside the gas flow passage increases, at this time, the gas pressure in the premix chamber 36 increases, and the gas pressure in the sealed space 52 also increases accordingly, such that the pressure suffered by the leather diaphragm 48 in the sealed space can counteract or partially counteract the force suffered by the proportional valve 18 which is opposite to the force for driving the valve cartridge 46 to open, and thus the influence of the reverse wind pressure to the proportional valve 18 is reduced.

In one embodiment, the second pressure sensor assembly 26 has a fourth conduit 56 that is in communication with upstream of the outlet end 34 and a fifth conduit 58 that is in communication with downstream of the outlet end 34.

In the present embodiment, the second pressure sensor assembly 26 can have two pressure measuring ports, of which one is in communication with upstream of the outlet end 34 via the fourth conduit 56 and the other one is in communication with downstream of the outlet end 34 via the fifth conduit 58.

In the present embodiment, generally there will be a pressure change after the fuel gas flows out from the fuel gas conduit 16 through the outlet end 34. In general, gas pressure at the downstream of the outlet end 34 is less than gas pressure at the upstream of the outlet end 34. The downstream of the outlet end 34 joins the gas flow passage of the dual sensor combustion system 10, and fuel gas flows out from the outlet end 34 to be mixed with air in the gas flow passage. As such, there is a pressure difference between the upstream and downstream of the outlet end 34.

In a specific embodiment, the fourth conduit 56 is connected between the outlet end 34 and the proportional valve 18, and the fifth conduit 58 is in communication with the premix chamber 56. Such arrangement can enable the second pressure sensor assembly 26 to relatively accurately measure the pressure of fuel gas in the fuel gas conduit 16. In addition, the gas pressure in the premix chamber 36 is relatively stable, in comparison with that adjacent to the outlet end 34, such that the gas pressure in the premix chamber 36 can better represent the gas pressure at the downstream of the outlet end 34.

In a specific embodiment, the second pressure sensor assembly 26 obtains a fifth pressure signal by detecting the fourth conduit 56, and obtains a sixth pressure signal by detecting the fifth conduit 58; the second pressure signal output by the second pressure sensor assembly 26 to the control unit is a difference value between the fifth pressure signal and the sixth pressure signal. According to Bernoulli's equation in hydromechanics, the fuel gas flow can be determined based on the difference value. The difference value can relatively accurately represent the pressure apparatus in the fuel gas conduit 16, and thereby can relatively accurately correspond to the flow of the fuel gas.

In a specific embodiment, the third conduit 54 is connected to the premix chamber 36 by a conduit after connecting to the fifth conduit 58. Such arrangement can make the arrangement of the integral structure simpler. The third conduit 54 and the fifth conduit 58 can be in communication with each other by using a tee structure.

In one embodiment, the predetermined parameters include thermal load. In this present embodiment, combustion thermal load may have a certain correspondence relationship with the set water temperature of the dual sensor combustion system 10, and by including combustion thermal load in the predetermined parameters, a correspondence relationship is established between the combustion thermal load and the first and second target pressure signals. Thus, establishment of a correspondence relationship between the set water temperature of the dual sensor combustion system 10 and the first target pressure signal, the second target pressure signals is achieved. The correspondence relationship can be a linear function, a quadratic function or a higher order function.

In a specific embodiment, the combustion thermal load can be obtained by calculation using the following formula.

$$Q_{heat}=(T_{set}-T_{enter})*Q_{flow}$$

Wherein, $Q_{heat}$ represents the combustion thermal load, $T_{set}$ represents the set water temperature, $T_{enter}$ represents the inlet water temperature, and $Q_{flow}$ represents the actual water flow.

It can be seen from the above formula that, there is a certain correspondence relationship between the combustion thermal load and the set water temperature. In addition, the dual sensor combustion system 10 gains heat by combustion of fuel gas, so that there is a certain correspondence relationship between the combustion thermal load and the amount of fuel gas.

In a specific embodiment, the correspondence relationship may include $F=mP^n+c$, wherein F is the combustion thermal load, P is the second target pressure signal, m is the proportionality coefficient measured by experiments, c is a constant measured by experiments, and the value of n can be set correspondingly according to the practical requirements for products.

In the present embodiment, by including the combustion thermal load in the preset parameters, so that when the dual sensor combustion system 10 starts to operate, can determine the combustion thermal load based on the set water temperature, and then determine the first target pressure signal and the second target pressure signal. The control unit 20 can control operations of the stepless speed regulating fan 14 and the proportional valve 18 according to the relationship respectively between the first pressure signal and the first target pressure signal, and between the second pressure signals and the second target pressure signal. As such, the dual sensor combustion system 10 can supply hot water that has reached the set water temperature quickly, thereby bringing convenience to the user.

In a specific embodiment, the correspondence relationship includes a target combustion thermal load and a set water temperature corresponding to it, when the combustion thermal load generated by the combustor 12 is not consistent with a target thermal load value corresponding to the current set water temperature, the control unit 20 controls the opening of the proportional valve 18, until the thermal load value reaches the target thermal load value.

In the present embodiment, the correspondence relationship may include a function relationship between the combustion thermal load and the set water temperature which is represented by the above formula. Or, a data table of the relationship between the target combustion thermal load and the set water temperature can be obtained by using the experimental data, and the data table is stored in the storage 28 as the correspondence relationship.

In the present embodiment, when the combustion thermal load produced by the combustor 12 is less than the target combustion thermal load, the combustion thermal load can be raised to the target combustion thermal load by increasing an opening of the proportional valve 18 to thereby increase supply of the fuel gas. When the combustion thermal load produced by the combustor 12 is higher than the target combustion thermal load, the combustion thermal load can be lowered to the target combustion thermal load by decreasing the opening of the proportional valve 18 to thereby decrease the supply of the fuel gas. As such, it is possible to realize to control the opening of the proportional valve 18, based on the relationship between the combustion thermal load and the target combustion thermal load of the combustor 12, and thereby control the operation process of the whole dual sensor combustion system 10. It can be understood that, during the process in which the control unit 20 controls the proportional valve 18, it can also controls the rotation speed of the stepless speed regulating fan 14 together.

In a specific embodiment, when the second pressure signal detected by the second pressure sensor assembly 26 is lower than the second target pressure signal corresponding to the target thermal load, the control unit 20 controls the proportional valve 18 to increase its opening, until the sensed combustion thermal load value reaches the target thermal load value.

In the present embodiment, when the second pressure signal is lower than the second target pressure signal corresponding to the target combustion thermal load, it can represent that the current combustion thermal load is less than the target combustion thermal load, and at this time, there is a need to increase the current combustion thermal load. The control unit 20 can increase supply of fuel gas by controlling the opening of the proportional valve 18 to thereby increase the combustion thermal load in the combustor 12. When the combustion thermal load reaches the target combustion thermal load, the opening of the proportional valve 18 can be maintained. As such, it is possible to realize that the dual sensor combustion system 10 can supply hot water that has reached the set water temperature.

Please refer to FIG. 1 and FIG. 2. In one embodiment, the combustor 12 is provided with an inducting needle 15 for detecting an ion current signal value during the flame combustion process; an output end of the inducting needle 15 is connected with the control unit 20; and the preset parameters include a target ion current signal value.

In the present embodiment, the combustor 12 can be provided with the inducting needle 15 to detect an ion current signal during flame combustion. Then the inducted strength of the ion current signal can be used as a part of the bases for the control unit 20 to control the stepless speed regulating fan 14 and the proportional valve 18.

In the present embodiment, an output end of the inducting needle 15 is connected to the control unit 20, such that the control unit 20 can receive the ion current signal generated by the inducting needle 15, and then obtains an ion current signal value based on certain algorithms. By setting a target ion current signal value in the preset parameters to be compared with the currently received ion current signal value, the control unit 20 can further control at least one of the stepless speed regulating fan 14 and the proportional valve 18 according to the correspondence relationship. There is a correspondence relationship between the target ion current signal value and the second target pressure. In other words, the magnitude of the ion current inducted by the inducting needle 15 is affected by an amount of fuel gas, i.e., the more fuel gas is supplied for combustion, the stronger the produced ion current is, and correspondingly the greater the ion current value is. In contrast, the less the fuel gas for combustion is, the weaker the produced ion current is, and correspondingly the smaller the ion current value is. Then, there is a correspondence relationship between the amount of fuel gas and the second target pressure signal, so that there is also a correspondence relationship between the ion current value and the second target pressure signal value. The correspondence relationship may be a function relationship, and may also be a corresponding data value which is obtained by experiments and is recorded by a data table.

In one embodiment, the combustor 12 includes a combustion region and a detection region, flame in the combustion region is more stable than flame in the detection region, and the inducting needle 15 is provided above the detection region of the combustor 12.

In the present embodiment, in order to facilitate the inducting needle 15 to induct the ion current, the detection region may be provided on the combustor 12. By designing fire holes in the detection region, flame in the detection region, relative to flame in the other parts of the combustor 12, can be less stable and more likely to float, and thus reflects more quickly and more obviously to the fluctuation of the ratio of air. As such, the detected ion current signal value can reflect quickly and exactly a supply state of fuel gas and air.

In one embodiment, the correspondence relationship can include a target ion current signal value corresponding to the second target pressure signal; when the first pressure signal reaches the first target pressure signal, the second pressure signal reaches the second target pressure signal, and the detected ion current signal value is still less than the target ion current signal value, the control unit 20 controls the stepless speed regulating fan 14 to reduce its rotation speed until the ion current reaches the target ion current, and the control unit 20 updates the correspondence relationship in the storage 28 based on the current first pressure signal and second pressure signal.

In the present embodiment, the first target pressure signal and the second target pressure signal can be determined based on an effective content in the fuel gas in normal situations, for example, the standard determined for the first target pressure signal and the second target pressure signal is that the effective content in the fuel gas is 100%. In some situations, in the actual workplaces of the dual sensor combustion system 10, the effective content in the fuel gas may be slightly less than the standard of effective content of fuel gas corresponding to the first target pressure signal and the second pressure signal, for example, the effective content in the fuel gas in an actual workplace is 95%. At this time, when the first pressure signal reaches the first target pressure signal, and the second pressure signal reaches the second target pressure signal, the detected ion current may still be lower than the target ion current. At this time, an amount of air mixed in the fuel gas for combustion can be reduced by reducing the rotation speed of the stepless speed regulating fan 14, which is found by experiments will raise the ion current value to some extent. If the ion current value increases to the target ion current signal value at this time, it represents that the current first pressure signal second pressure signal are adapted to the fuel gas condition of the workplace of the dual sensor combustion system 10. At this time, the correspondence relationship stored in the storage 28 can be updated according to the correspondence relationship between the first pressure signal and the second pressure signal.

Please refer to FIG. 1 and FIG. 2 together. In a specific embodiment, the correspondence relationship between the first target pressure signal and the second target pressure signal may be Y=KX+B. When the first pressure signal reaches the first target pressure signal, the second pressure signal reaches the second target pressure signal, while the ion current value is less than the target ion current signal value, the control unit 20 controls the stepless speed regulating fan 14 to reduce its rotation speed, such that the first pressure signal will decrease and the first pressure signal is remained unchanged. During this process, when the first pressure signal is a certain value, the ion current value increases to the target ion current signal value, at this time, the correspondence relationship between the first target pressure signal and the second target pressure signal stored in the storage 28 is updated based on the current correspondence relationship Y=KX+B' between the first pressure signal and the second pressure signal, wherein, the value of K can be maintained unchanged while the value of the constant B is altered into B'. This realizes that the dual sensor combustion system 10 can have a certain function of auto-adaptation to the fuel gas quality of the workplace, so as to provide convenience for the user.

In one embodiment, the correspondence relationship includes the target ion current signal value and the set water temperature corresponding to it; the control unit 20 can execute at least one of: controlling the stepless speed regulating fan 14 to reduce its rotation speed when the inducting needle 15 detects that the ion current signal value is less than the target ion current signal value corresponding to the current set water temperature, so as to make the first pressure signal tend to the first target pressure signal corresponding to the target ion current signal value; and, controlling the opening of the proportional valve 18 to make the second pressure signal tend to the second target pressure signal corresponding to the target ion current.

In the present embodiment, by setting the target ion current signal value as corresponding to the set water temperature, the control unit 20 can determine a target ion current signal value based on the current set water temperature, and the correspondence relationship between the first target pressure signal and the second target pressure signal is used as a basis for regulating the stepless speed regulating fan 14 and the proportional valve 18.

In a specific embodiment, after the dual sensor combustion system 10 starts to operate, the target ion current value corresponding to the set water temperature is determined, and the control unit 20 controls the stepless speed regulating fan 14 to increase its rotation speed, or controls the opening of the proportional valve 18, based on the correspondence relationship between the first target pressure signal and the second target pressure signal; or, the control unit 20 controls the stepless speed regulating fan 14 to increase its rotation speed, and controls the opening of the proportional valve 18, based on the correspondence relationship between the first target pressure signal and the second target pressure signal. When the ion current signal value reaches the target ion current signal value, the control unit 20 can control the rotation speed of the stepless speed regulating fan 14 to maintain the first pressure signal, and control the opening of the proportional valve 18 to maintain the second pressure signal.

In one embodiment, when the first pressure signal reaches the first target pressure signal, and the second pressure signal reaches the second target pressure signal, while the detected ion current signal value is still less than the target ion current signal value, the control unit 20 controls the stepless speed regulating fan 14 to increase its rotation speed and correspondingly controls the proportional valve to increase its opening 18, until the detected ion current signal value reaches the target ion current signal value, and the control unit 20 updates the correspondence relationship in the storage 28 based on the current first pressure signal and second pressure signal.

In the present embodiment, when the first pressure signal reaches the first target pressure signal and the second pressure signal reaches the second target pressure signal, while the detected ion current signal value is still less than the target ion current signal value, it indicates that the effective content in the fuel gas of the workplace of the dual sensor combustion system 10 is lower than the standard set for the first target pressure signal and the second target pressure signal. The control unit 20 controls the stepless speed regulating fan 14 to increase its rotation speed and controls the proportional valve 18 to increase its opening, based on the correspondence relationship between the first target pressure signal and the second target pressure signal. Thus, the supply of fuel gas and air in the combustor 12 is increased to thereby increase the ion current signal value of the combustor 12. When the detected ion current signal value reaches the target ion current value, it indicates that there is a correspondence relationship between the current first and second pressure signals and the target ion current value, according to which the correspondence relationship stored in the storage 28 is updated, thus it is realized that the dual sensor combustion system 10 can be automatically adapted to the fuel gas condition in the workplaces.

As can be seen from the above technical solutions provided by the embodiments of the present application, it is possible for the embodiments of the present application by setting the first target pressure signal of the gas flow passage and the second target pressure signal of the fuel gas conduit 16, to achieve to set different target standards for different operation states. By establishing a correspondence relationship between the first target pressure signal and the second target pressure signal, during control, it is possible to selectively control at least one of the stepless speed regulating fan 14 and the proportional valve 18 to satisfy the demand of the dual sensor combustion system 10 for heat energy during the operation process, based on the currently detected the first pressure signal and the second pressure signal. Then, the dual sensor combustion system 10 can better control and harmonize the proportional valve 18 and the stepless speed regulating fan 14 for different operation environments including pressure of the fuel gas conduit 16 and the outside wind pressure, thereby enabling the gas hot water supplying apparatus 10 to operate steadily. In addition, by matching the first target pressure signal and the second pressure signal, it is possible to achieve more precise guarantee of optimized partition ratio of the actual flow of air and fuel gas, so as to enable the fuel gas to be combusted more sufficiently, and thereby the discharged pollutant can be very few.

It can be understood that the multiple embodiments in the present application documents are described in progressive relationship, and each embodiment places emphasis on the description of content different from that of the other embodiments. The same terms between different embodiments can be explained with reference to each other. Besides, persons skilled in the art shall know that the embodiments in the present application documents can be combined with each other without paying any creative effort.

Although the present application is described by using the embodiments, under the inspiration of the technical essence of the present application, person skilled in the art can combine the above multiple embodiments, and can also make changes to the embodiments of the present application, which should all be included in the protection scope of the present application as long as the function and effect achieved by them are identical or similar to that of the present application.

The invention claimed is:

1. A dual sensor combustion system, wherein the dual sensor combustion system in its interior has a gas flow passage from an air inlet to a smoke exhaust port, the dual sensor combustion system comprising:

a combustor;

a stepless speed regulating fan that supplies air for the combustor;

a fuel gas conduit that is in communication with the combustor;

a proportional valve provided on the fuel gas conduit;

a control unit electrically connected to the stepless speed regulating fan and the proportional valve;

a first pressure sensor assembly that detects a first pressure signal of the gas flow passage, a signal output end of the first pressure sensor assembly being connected to the control unit;

a second pressure sensor assembly that detects a second pressure signal of fuel gas conduit, a signal output end of the second pressure sensor assembly being connected to the control unit;

a storage that stores a correspondence relationship between a first target pressure signal of the gas flow passage and a second target pressure signal of the fuel gas conduit;

the control unit controlling at least one of the stepless speed regulating fan and the proportional valve based on the first pressure signal, the second pressure signal and the correspondence relationship.

2. The dual sensor combustion system according to claim 1, wherein: the fuel gas conduit has a connection section to a fuel gas pipeline, the fuel gas pipeline supplies fuel gas for the fuel gas conduit; the second pressure signal is a pressure signal between an outlet end of the fuel gas conduit and the connection section.

3. The dual sensor combustion system according to claim 2, wherein: the proportional valve is located between the connection section and the outlet end, and the second pressure signal is a pressure signal between the proportional valve and the outlet end.

4. The dual sensor combustion system according to claim 1, wherein: the storage stores a correspondence relationship between the first target pressure signal of the gas flow passage, the second target pressure signal of the fuel gas conduit and a preset parameter of the dual sensor combustion system, and the control unit controls at least one of the stepless speed regulating fan and the proportional valve based on the first pressure signal, the second pressure signal and the correspondence relationship.

5. The dual sensor combustion system according to claim 4, wherein: the preset parameter includes a combustion thermal load.

6. The dual sensor combustion system according to claim 5, wherein: the dual sensor combustion system has a set water temperature, the correspondence relationship includes a target combustion thermal load and the set water temperature corresponding to it;

when a thermal load produced by the combustor is not consistent with the target thermal load value corresponding to a current set water temperature, the control unit controls an opening of the proportional valve, until the thermal load value reaches the target thermal load value.

7. The dual sensor combustion system according to claim 6, wherein when the thermal load produced by the combustor is less than the target thermal load value corresponding to the current set water temperature, the control unit controls the proportional valve to increase the opening, until the thermal load value reaches the target thermal load value.

8. The dual sensor combustion system according to claim 5, wherein: the dual sensor combustion system has a set water temperature, and the correspondence relationship includes a target combustion thermal load and the set water temperature corresponding to it;

when the second pressure signal detected by the second pressure sensor assembly is lower than the second target pressure signal corresponding to the target combustion thermal load, the control unit controls the proportional valve to increase the opening, until the sensed combustion thermal load value reaches the target thermal load value.

9. The dual sensor combustion system according to claim 4, wherein: the combustor is provided with an inducting needle for detecting an ion current signal value during flame combustion process; an output end of the inducting needle is connected to the control unit; and the preset parameter includes a target ion current signal value.

10. The dual sensor combustion system according to claim 9, wherein: the combustor includes a combustion region and a detection region, flame in the combustion region is more stable than flame in the detection region, and the inducting needle is provided above the detection region of the combustor.

11. The dual sensor combustion system according to claim 9, wherein: the correspondence relationship includes the target ion current signal value corresponding to the second target pressure signal;

when the first pressure signal reaches the first target pressure signal, the second pressure signal reaches the second target pressure signal, and the detected ion current signal value is still less than the target ion current signal value, the control unit controls the stepless speed regulating fan to reduce its rotation speed until the ion current reaches the target ion current, and the control unit updates the correspondence relationship in the storage based on the current first pressure signal and second pressure signal.

12. The dual sensor combustion system according to claim 9, wherein: the dual sensor combustion system has a set water temperature, the correspondence relationship includes the target ion current signal value and the set water temperature corresponding to it;

the control unit is capable of performing at least one of: when the inducting needle detects that the ion current signal value is less than the target ion current signal value corresponding to the current set water temperature, controlling the rotation speed of the stepless speed regulating fan, so as to make the first pressure signal tend to the first target pressure signal corresponding to the target ion current signal value;

and, controlling the opening of the proportional valve, so as to make the second pressure signal tend to the second target pressure signal corresponding to the target ion current.

13. The dual sensor combustion system according to claim 12, wherein: when the first pressure signal reaches the first target pressure signal, the second pressure signal reaches the second target pressure signal, and the detected ion current signal value is still less than the target ion current signal value, the control unit controls the stepless speed regulating fan to increase the rotation speed and correspondingly controls the proportional valve to increase the opening, until the detected ion current signal value reaches the target ion current signal value, and the control unit updates the correspondence relationship in the storage based on the current first pressure signal and second pressure signal.

14. The dual sensor combustion system according to claim 1, wherein: the stepless speed regulating fan is located upstream of the combustor along a flow direction of gas flow in the gas flow passage.

15. The dual sensor combustion system according to claim 14, wherein: the first pressure signal detected by the first pressure sensor assembly is a pressure signal upstream of a impeller of the stepless speed regulating fan.

16. The dual sensor combustion system according to claim 14, wherein: the first pressure sensor assembly has a first conduit that is in communication with a first predetermined pressure measuring position downstream of a impeller of the stepless speed regulating fan and a second conduit that is in communication with a second predetermined pressure measuring position downstream of the impeller of the stepless speed regulating fan, and the first predetermined pressure measuring position is located upstream of the second predetermined pressure measuring position.

17. The dual sensor combustion system according to claim 16, wherein: the first pressure sensor assembly obtains a third pressure signal by detecting the first conduit, and obtains a fourth pressure signal by detecting the second conduit; the first pressure signal output by the first pressure sensor assembly to the control unit is a difference value between the third pressure signal and the fourth pressure signal.

18. The dual sensor combustion system according to claim 1, wherein: the stepless speed regulating fan is located downstream of the combustor along a flow direction of gas flow in the gas flow passage.

19. The dual sensor combustion system according to claim 18, wherein: the first pressure signal detected by the first pressure sensor assembly is a pressure signal upstream of a impeller of the stepless speed regulating fan.

20. The dual sensor combustion system according to claim 18, wherein: the first pressure sensor assembly has a first conduit that is in communication with a first predetermined pressure measuring position downstream of a impeller of the stepless speed regulating fan and a second conduit that is in communication with a second predetermined pressure measuring position downstream of the impeller of the stepless speed regulating fan, and the first predetermined pressure measuring position is located upstream of the second predetermined pressure measuring position.

21. The dual sensor combustion system according to claim 20, wherein: the first pressure sensor assembly obtains a third pressure signal by detecting the first conduit, and obtains a fourth pressure signal by detecting the second conduit; the first pressure signal output by the first pressure sensor assembly to the control unit is a difference value between the third pressure signal and the fourth pressure signal.

22. The dual sensor combustion system according to claim 1, wherein: the dual sensor combustion system further comprises a premix chamber that is in communication with the combustor, an outlet end of the fuel gas conduit and the stepless speed regulating fan; the fuel gas flowed out from the fuel gas conduit and the air supplied by the gas flow passage can be mixed in the premix chamber and then reach the combustor.

23. The dual sensor combustion system according to claim 22, wherein: the proportional valve has a first housing and a second housing; the first housing is formed with a fuel gas inlet and a fuel gas outlet, and a valve cartridge of the proportional valve is provided at the fuel gas outlet; a leather diaphragm of the proportional valve is provided between the first housing and the second housing and is connected to a valve cartridge driving mechanism of the proportional valve; a sealed space is formed at least by the second housing and the leather diaphragm;

the dual sensor combustion system further comprises a third conduit that communicates the sealed space with the premix chamber.

24. The dual sensor combustion system according to claim 23, wherein: the second pressure sensor assembly has a fourth conduit that is in communication with upstream of the outlet end of the fuel gas conduit and a fifth conduit that is in communication with downstream of the outlet end of the fuel gas conduit.

25. The dual sensor combustion system according to claim 24, wherein: the fourth conduit is connected between the outlet end and the proportional valve, and the fifth conduit is in communication with the premix chamber.

26. The dual sensor combustion system according to claim 25, wherein: the second pressure sensor assembly obtains a fifth pressure signal by detecting the fourth conduit, and obtains a sixth pressure signal by detecting the fifth conduit; the second pressure signal output by the second pressure sensor assembly to the control unit is a difference value between the fifth pressure signal and the sixth pressure signal.

27. The dual sensor combustion system according to claim 26, wherein: the third conduit is connected to the premix chamber by a conduit after connecting to the fifth conduit.

* * * * *